US012152825B2

(12) United States Patent
Navalgund et al.

(10) Patent No.: US 12,152,825 B2
(45) Date of Patent: Nov. 26, 2024

(54) TOE-KICK

(71) Applicant: WHIRLPOOL CORPORATION, Benton Harbor, MI (US)

(72) Inventors: Manjunathraddi Navalgund, Pune (IN); Abhay Naik, Stevensville, MI (US); Sanket V. Phalak, Pune (IN); Rahul S. Chhajed, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 320 days.

(21) Appl. No.: 17/577,417

(22) Filed: Jan. 18, 2022

(65) Prior Publication Data

US 2023/0228475 A1 Jul. 20, 2023

(51) Int. Cl.
*F25D 23/00* (2006.01)

(52) U.S. Cl.
CPC ..... *F25D 23/006* (2013.01); *F25D 23/003* (2013.01); *F25D 2323/0011* (2013.01); *F25D 2323/0021* (2013.01); *F25D 2323/00264* (2013.01); *F25D 2323/00274* (2013.01); *F25D 2323/024* (2013.01); *F25D 2700/02* (2013.01)

(58) Field of Classification Search
CPC ..... F25D 23/006; F25D 23/003; F25D 2323/002; F25D 2323/0021; F25D 2323/00264; F25D 2323/00274; F25D 2323/0011; F25D 2323/024; F25D 2700/02
See application file for complete search history.

(56) References Cited

U.S. PATENT DOCUMENTS 2,660,505 A * 11/1953 Eck ..... F25D 23/006 62/297
2,889,901 A * 6/1959 Morrissey, Jr. ..... F25D 23/003 52/750
3,157,306 A * 11/1964 Courson ..... F25D 21/04 62/277
3,403,529 A * 10/1968 Reber, Jr. ..... F25D 21/14 62/277
4,932,224 A * 6/1990 Katterhenry ..... F25D 23/10 312/236

(Continued)

FOREIGN PATENT DOCUMENTS

CN 110375507 A * 10/2019
EP 2426447 3/2012

(Continued)

*Primary Examiner* — Andrew Roersma
(74) *Attorney, Agent, or Firm* — PRICE HENEVELD LLP

(57) ABSTRACT

A refrigerator includes a main body and a supporting structure disposed below the main body upon which the refrigerator is supported on a floor. A pair of guide rails is affixed to a bottom wall of the main body along a pair of opposed lateral sides of the main body and extend between a rear wall and a front side of the main body. A portion of a heat loop tube for a refrigeration system extends externally out of the internal storage compartment and is disposed below the main body and within a cavity. A toe kick is disposed proximate a bottom edge of the front side of the main body and proximate the floor for containing the portion of the heat loop tube within the cavity and isolating the portion of the heat loop tube from an exterior of the refrigerator.

15 Claims, 5 Drawing Sheets

(56) References Cited

U.S. PATENT DOCUMENTS

| | | | | | |
|---|---|---|---|---|---|
| 5,992,960 | A * | 11/1999 | Wolanin | F25D 21/04 | 312/265.5 |
| 6,036,292 | A * | 3/2000 | Mandel | F25D 23/062 | 312/401 |
| 6,036,293 | A * | 3/2000 | Anell | F25D 23/063 | 312/401 |
| 7,137,677 | B2 * | 11/2006 | Hong | F25D 23/00 | 312/265.6 |
| 8,899,070 | B2 * | 12/2014 | Eckartsberg | F25D 21/04 | 62/272 |
| 9,829,240 | B2 | 11/2017 | Staedel et al. | | |
| 10,345,027 | B1 * | 7/2019 | Lundqvist | F16M 11/048 | |
| 11,460,235 | B1 * | 10/2022 | Hunter | F25D 23/006 | |
| 2003/0141793 | A1 * | 7/2003 | Lee | F25D 23/063 | 312/401 |
| 2006/0152124 | A1 | 7/2006 | Pohl et al. | | |
| 2013/0340466 | A1 * | 12/2013 | Hines | F25D 23/00 | 62/452 |
| 2018/0149407 | A1 * | 5/2018 | Akalan | F25D 23/003 | |
| 2022/0373247 | A1 * | 11/2022 | Pagnozzi | F25D 29/005 | |
| 2022/0397336 | A1 * | 12/2022 | Lim | F25D 23/063 | |

FOREIGN PATENT DOCUMENTS

| | | | | |
|---|---|---|---|---|
| JP | H0942821 | | 2/1997 | |
| JP | H1137633 | | 12/1999 | |
| JP | 2016174641 | | 10/2016 | |
| WO | WO-2010092626 | A1 * | 8/2010 | F25D 23/00 |

* cited by examiner

TOE-KICK

BACKGROUND OF THE DISCLOSURE

The present disclosure generally relates to a refrigerator having an exposed portion of a heat loop tube, and more specifically, to a toe kick for a refrigerator to protect the exposed portion of the heat loop tube.

SUMMARY OF THE DISCLOSURE

According to one aspect of the present disclosure, a refrigerator includes a main body having an outer chassis and an internal storage compartment disposed within the outer chassis, wherein the outer chassis comprises a top wall, a rear wall, a pair of opposed side walls, a bottom wall, and a front side comprising an access aperture and a closure having an open position allowing access to the internal storage compartment and a closed position. A supporting structure is disposed below the internal storage compartment upon which the refrigerator is supported on a floor and forming a cavity below the main body, the supporting structure comprising a pair of guide rails affixed to the bottom wall of the main body along a pair of opposed side flanges of the main body and extending between the rear wall and the front side of the main body. A refrigeration system is adapted to provide cooled air within the internal storage compartment, the refrigeration system comprising a heat loop tube adapted to transfer heat energy out of the internal storage compartment, wherein a portion of the heat loop tube extends externally out of the internal storage compartment and is disposed below the main body and within the cavity. A toe kick is disposed proximate a bottom edge of the front side of the main body and proximate the floor for containing the portion of the heat loop tube within the cavity and isolating the portion of the heat loop tube from an exterior of the refrigerator.

Additional features of this aspect of the disclosure include a vertical gap created by the pair of guide rails below the bottom wall of the main body, the vertical gap being equal to a vertical height of each of the pair of guide rails, and the cavity being defined by the vertical height of each of the pair of guide rails, the bottom wall, and floor. A vertical height of the toe kick may correspond to the vertical gap, and the toe kick may extend vertically between the bottom edge of the front side of the main body and the floor. The portion of the heat loop tube may be disposed proximate the toe kick. The kick may extend across a frontal width of the main body and may be mounted to a front face of each of the guide rails on the pair of opposed side flanges. The toe kick may be a single piece structure having an exposed substantially flat front surface disposed proximate a lower edge of the main body of the refrigerator. The front surface may include a plurality of horizontally oriented slots by which an air flow may be directed to cool the portion of the heat loop tube. The pair of opposed side flanges may extend laterally from the front surface and provide a mounting structure by which the toe kick is attached to the front face of each of the guide rails by each of the pair of opposed side flanges of the front surface. The toe kick further may have an upper flange extending rearwardly and orthogonally relative to the front surface between the pair of opposed side flanges, wherein the upper flange abuts the bottom wall of the refrigerator and cooperates with each of the pair of guide rails, the bottom wall, and the floor to define the cavity within which the portion of the heat loop tube is disposed. The toe kick may further have a lower flange extending rearwardly and orthogonally relative to the front surface between the pair of opposed side flanges, wherein the lower flange comprises a pair of laterally extending mounting ears and a central rearwardly extending mounting ear. Each of the pair of laterally extending mounting ears and the central rearwardly extending mounting ear may be mounted to the bottom wall of the main body, thus creating a vented enclosure within which the portion of the heat loop tube is contained. A first of the pair of opposed side flanges may be adapted to mount a lower door hinge assembly of the closure. A second of the pair of opposed side flanges, opposed to the first of the pair of opposed side flanges, may be adapted to mount a switch for sensing the position of closure. The switch may comprise a reed switch.

According to yet another aspect of the present disclosure, a toe kick for a refrigerator includes a single piece structure having an exposed substantially flat front surface disposed proximate the lower edge of the main body of the refrigerator. A plurality of horizontally oriented slots disposed on the front surface by which an air flow may be directed to cool a portion of a heat loop tube disposed below the refrigerator. A pair of opposed side flanges extend laterally from the front surface and provide a mounting structure by which the toe kick is attached to a front face of each of a pair of guide rails disposed below a main body of the refrigerator and upon a floor by which the refrigerator is supported, the pair of guide rails being affixed to a bottom wall of the main body along a pair of opposed lateral sides of the main body and extending between a rear wall and a front side of the main body. An upper flange extends rearwardly and orthogonally relative to the front surface between the pair of opposed side flanges. A lower flange extends rearwardly and orthogonally relative to the front surface between the pair of opposed side flanges, wherein the lower flange is includes a pair of laterally extending mounting ears and a central rearwardly extending mounting ear.

Additional features of this aspect of the disclosure may include each of the pair of laterally extending mounting ears and the central rearwardly extending mounting ear being mounted to a bottom wall of the main body, thus creating a vented enclosure within which the portion of the heat loop tube is contained. The toe kick may be disposed proximate a bottom edge of a front side of the main body and proximate the floor for isolating the portion of the heat loop tube within the cavity.

According to another aspect of the present disclosure, a toe kick for a refrigerator includes a single piece structure having an exposed substantially flat front surface disposed proximate the lower edge of the main body of the refrigerator. A pair of opposed side flanges extend laterally from the front surface and providing a mounting structure by which the toe kick is attached to a front face of each of a pair of guide rails disposed below a main body of the refrigerator and upon a floor by which the refrigerator is supported, the pair of guide rails being affixed to the bottom wall of the main body along a pair of opposed lateral sides of the main body and extending between a rear wall and a front side of the main body. A lower flange extends rearwardly and orthogonally relative to the front surface between the pair of opposed side flanges, wherein the lower flange includes a plurality of mounting ears by which the toe kick is operably coupled with a bottom wall of the refrigerator. A plurality of horizontally oriented slots are disposed on the front surface by which an air flow may be directed to cool a portion of a heat loop tube disposed in a cavity below the refrigerator.

Additional features of this aspect of the disclosure may include an upper flange extending rearwardly and orthogonally relative to the front surface between the pair of opposed side flanges, wherein the upper flange abuts the bottom wall of the refrigerator and cooperates with each of the pair of guide rails, the front face of the toe kick, the bottom wall, and the floor to define the cavity within which the portion of the heat loop tube is disposed. The refrigerator further may include a lower door hinge assembly of a closure of the refrigerator, wherein a first of the pair of opposed side flanges is adapted to mount the lower door hinge assembly of the closure.

These and other features, advantages, and objects of the present disclosure will be further understood and appreciated by those skilled in the art by reference to the following specification, claims, and appended drawings.

Figure 1:
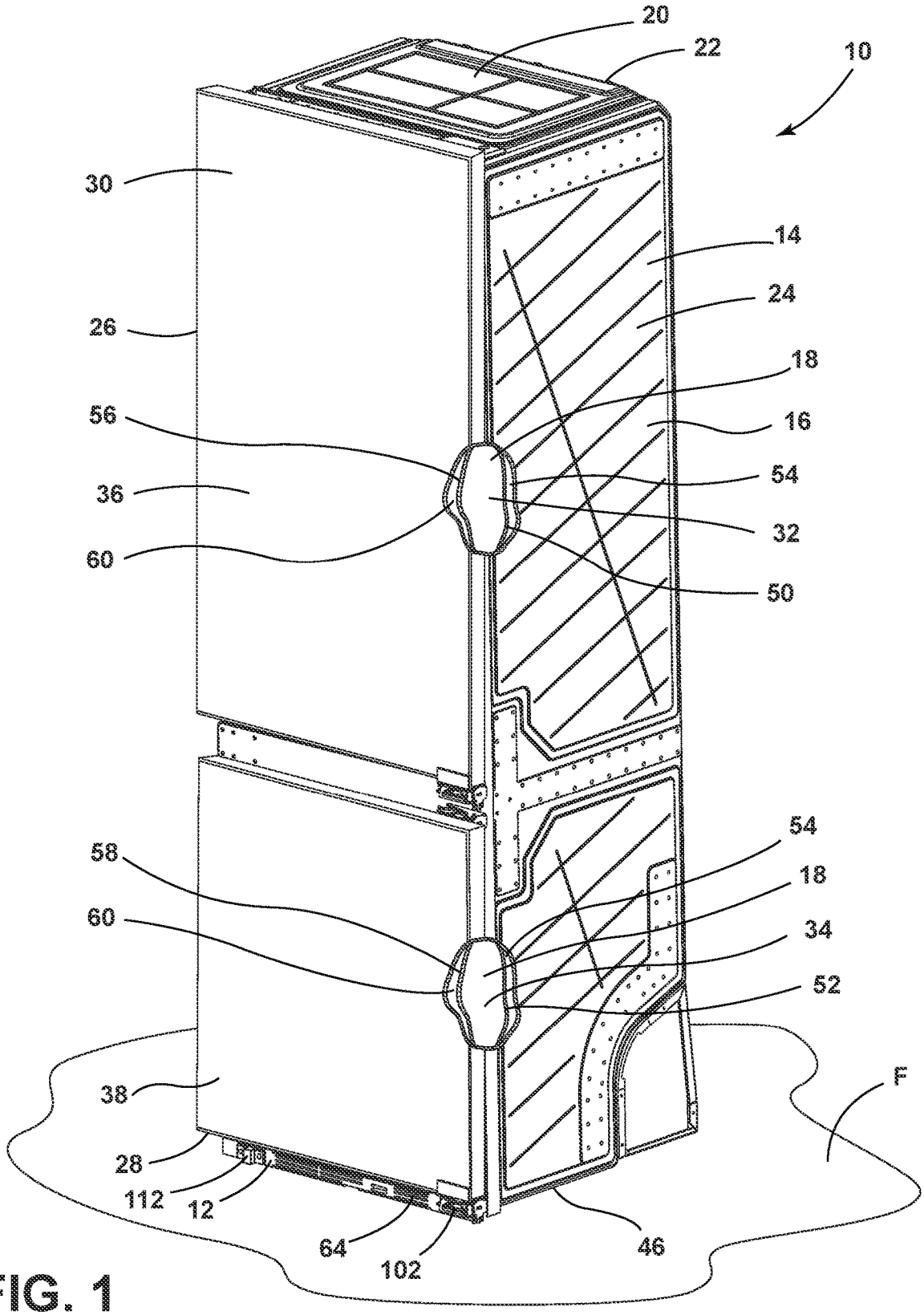
FIG. 1 is a top side perspective view of a refrigerator equipped with the toe kick of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a toe kick for a refrigerator to protect an exposed portion of the heat loop tube. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-4, reference numeral 10 generally designates a refrigerator equipped with the toe kick 12 of the present disclosure. The refrigerator 10 may include a main body 14 having an outer chassis 16 and an internal storage compartment 18 disposed within the outer chassis 16, wherein the outer chassis 16 comprises a top wall 20, a rear wall 22, a pair of opposed lateral side walls 24, 26, a bottom wall 28, and a front side 30 comprising an upper access aperture 32, a lower access aperture 34, an upper closure 36, and a lower closure 38. Each of the upper closure 36 and the lower closure 38 have an open position allowing access to the internal storage compartment 18 and a closed position. As is known, the outer chassis 16 may be clad with exterior finish panels (not shown) to obtain any manner of desired exterior design and styling motifs.

As shown FIG. 2, a supporting structure 40 may be disposed below the internal storage compartment 18 upon which the refrigerator 10 is supported on a floor F. The supporting structure 40 may include a pair of guide rails 42, 44 affixed to the bottom wall 28 of the main body 14 along a pair of opposed lateral sides 46, 48 of the main body 14 and extending between the rear wall 22 and the front side 30 of the main body 14. The pair of guide rails 42, 44 may create a vertical gap G below the bottom wall 28 of the main body 14, the vertical gap G being equal to a vertical height of each of the pair of guide rails 42, 44. So situated, the pair of guide rails 42, 44 partially forms a cavity C defined by the vertical height of each of the pair of guide rails 42, 44, the bottom wall 28, and the floor F.

The internal storage compartment 18 may comprise a plurality of injection molded shells 50, 52 that may be mounted within the outer chassis 16, as shown in FIG. 1. In particular, the upper shell 50 corresponds to a cubicle for the storage of fresh food items and the lower shell 52 corresponds to a cubicle for the storage of frozen food items. The upper shell 50 and lower shell 52 may each be mounted within the outer chassis 16 so as form an air-tight interface between each of the upper shell 50 and lower shell 52 and the outer chassis 16, respectively, which in turn forms an air-tight envelope 54 about each of the upper shell 50 and lower shell 52. The air within the air-tight envelope 54 may then be evacuated to create a vacuum within the air-tight envelope 54, providing insulating properties and contributing to the energy efficiency of the refrigerator 10.

Figure 2:
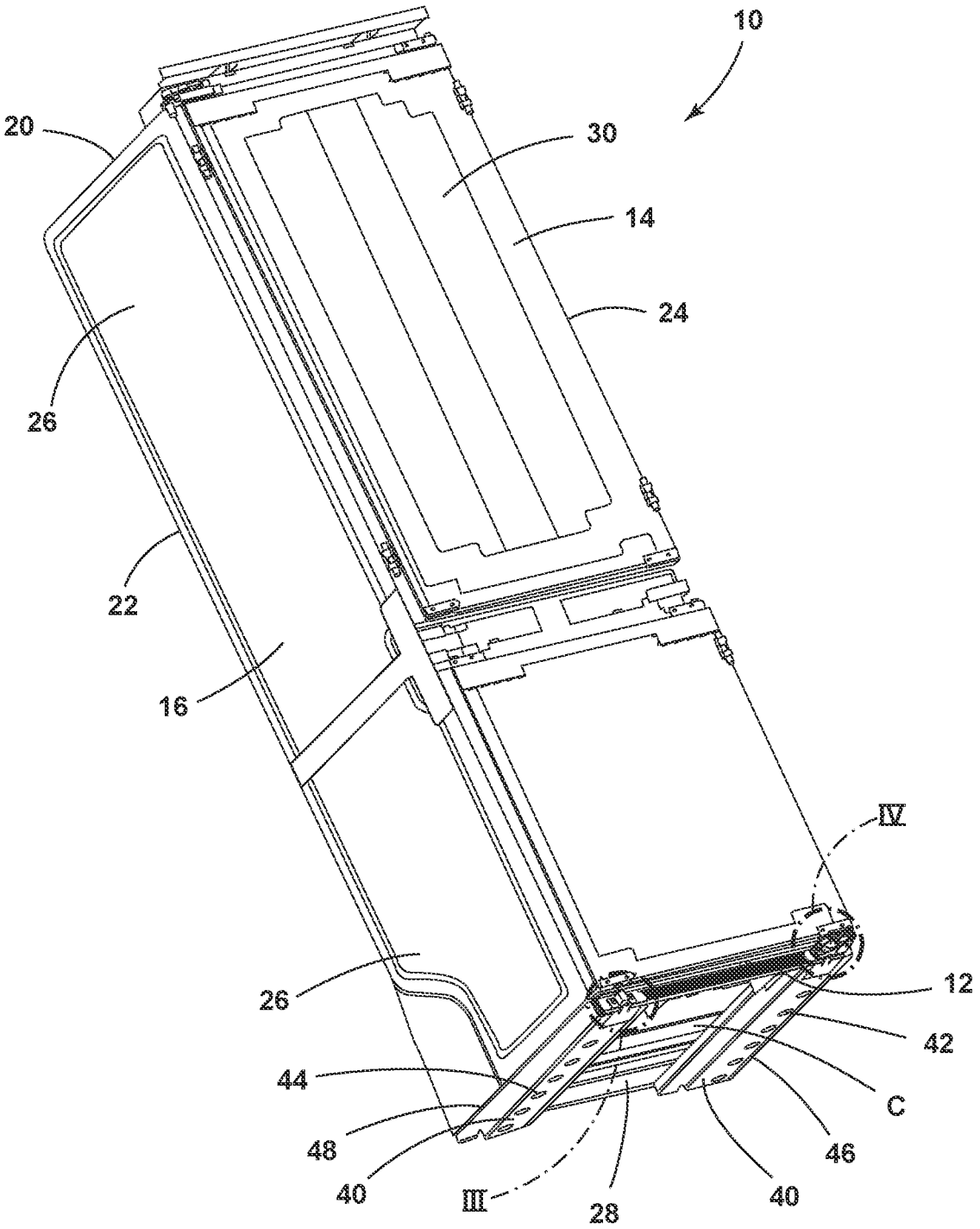
FIG. 2 is a bottom side perspective view the refrigerator equipped with the toe kick of the present disclosure shown in FIG. 1.

As shown in FIGS. 1 and 2, the upper closure 36 provides access to the cubicle for the storage of fresh food items and the lower closure 38 provides access to the cubicle for the storage of frozen food items. Each of the upper closure 36 and the lower closure 38 may similarly be provided with an upper injection molded shell 56 and lower injection molded shell 58 that may be mounted to an inner surface of the upper closure 36 and the lower closure 38, respectively, so as form an air-tight interface between the upper closure 36 and the lower closure 38, and the upper shell 56 and lower shell 58, respectively, which in turn forms an air-tight envelope 60 within each of the upper closure 36 and the lower closure 38. The air within the air-tight envelope 60 may similarly then be evacuated to create a vacuum within the air-tight envelope 60, again providing insulating properties and contributing to the energy efficiency of the refrigerator 10.

Figure 5:
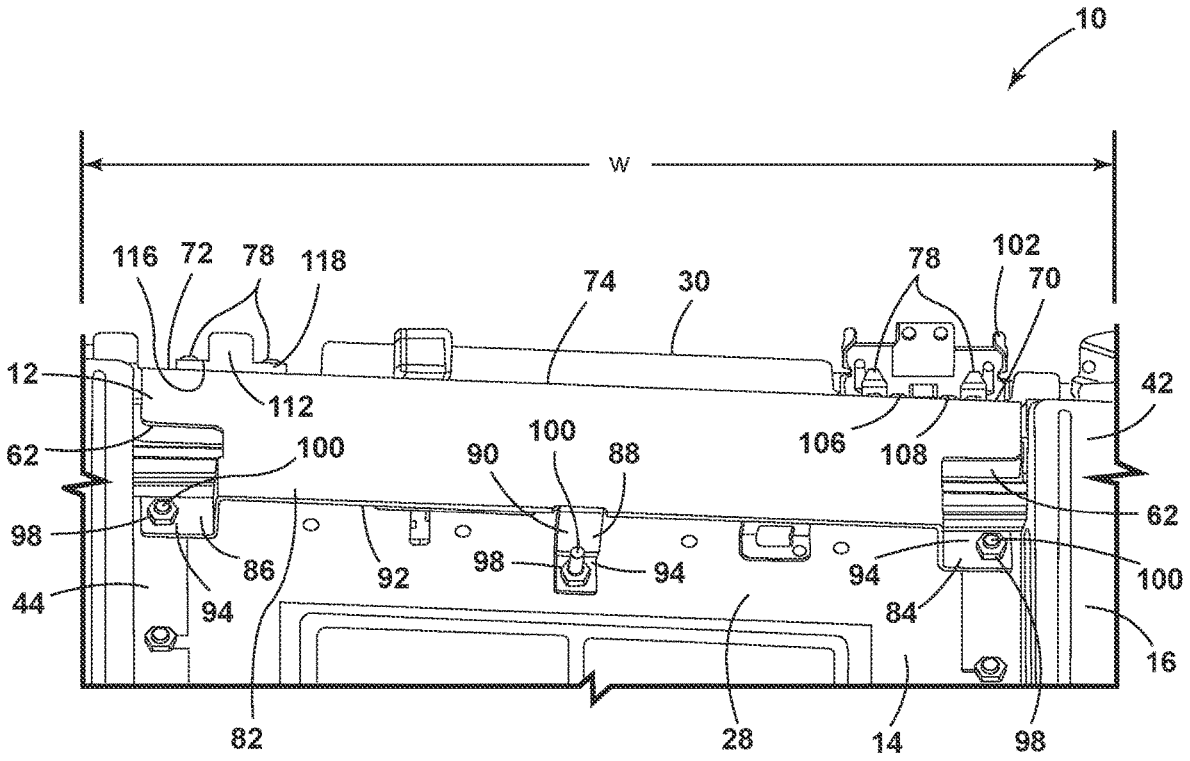
FIG. 5 is a partial bottom view of the refrigerator equipped with the toe kick of the present disclosure shown in FIG. 1.
Figure 6:
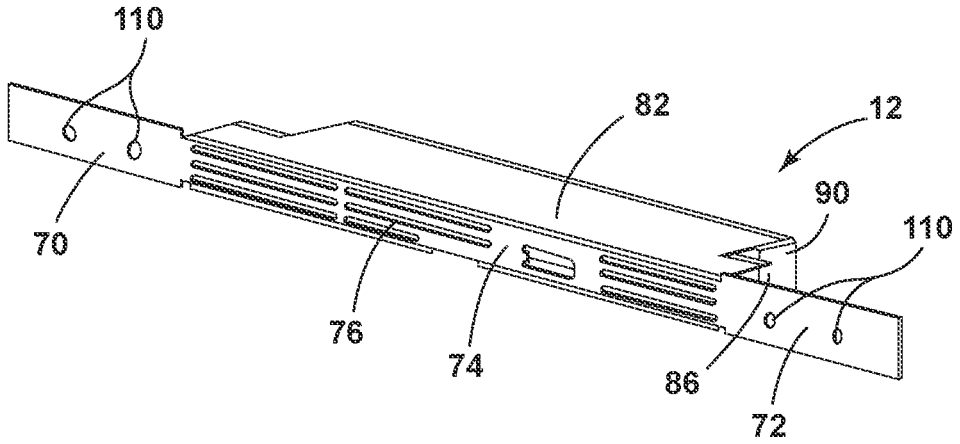
FIG. 6 is a bottom front perspective view of the toe kick of the present disclosure shown in FIG. 1.
Figure 7:
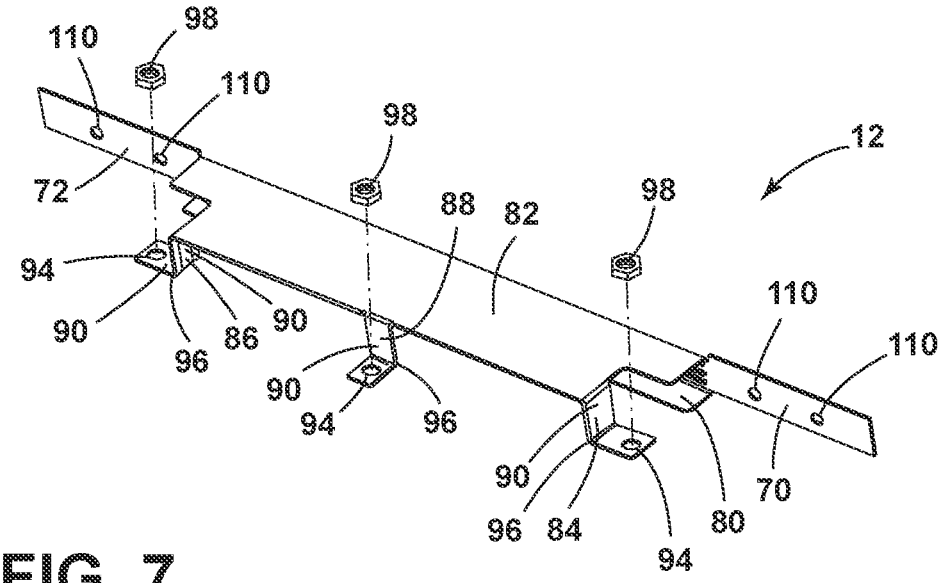
FIG. 7 is a bottom rear perspective view of the toe kick of the present disclosure shown in FIG. 1.

The refrigerator 10 includes a refrigeration system adapted to provide cooled air within the internal storage compartment 18. The refrigeration system may include the usual components of such systems, such as, inter alia, a compressor, condenser coil, expansion valve, evaporator coil, and related pumps, sensors and controllers, not shown. According to the present disclosure, the refrigeration system may also include a heat loop tube 62 adapted to transfer heat energy out of the internal storage compartment 18, for example, to assist in an automatic defrosting system (not shown). As shown in FIG. 5, a portion of the heat loop tube 62 may extend externally out of the internal storage compartment 18 and may be disposed below the main body 14 and within the cavity C.

As shown in the Figures, the toe kick 12 may be disposed proximate a bottom edge 64 of the front side 30 of the main body 14 and proximate the floor F for containing the portion of the heat loop tube 62 within the cavity C. The toe kick 12 thus isolates the portion of the heat loop tube 62 from an exterior of the refrigerator 10 and may protect the exposed portion of the heat loop tube 62 from damage. A vertical height of the toe kick 12 may correspond to the vertical gap G, and the toe kick 12 may extend vertically between the bottom edge 64 of the front side 30 of the main body 14 and the floor F, such that the portion of the heat loop tube 62 may be disposed proximate the toe kick 12.

As shown in FIGS. 1, 2, and 5, the toe kick 12 may extend across a frontal width W of the main body 14 and may be mounted to a front face 66, 68 of each of the pair of guide rails 42, 44 on a pair of opposed side flanges 70, 72. The toe kick 12 may consist of a single piece structure having an exposed substantially flat front surface 74 disposed proximate the bottom edge 64 of the main body 14 of the refrigerator 10. The toe kick 12 may be fabricated from metal, such as stamped steel, or it may be injection molded from a polymeric material.

The front surface 74 of the toe kick 12 may include a plurality of horizontally oriented slots 76 by which an air flow may be directed to cool the portion of the heat loop tube 62. The pair of opposed side flanges 70, 72 may extend laterally from the front surface 74 and provide a mounting structure by which the toe kick 12 may be attached to the front face 66, 68 of each of the guide rails 42, 44 by each of the opposed side flanges 70, 72 of the front surface 74 by a fastener 78, as further described below. The toe kick 12 may also include an upper flange 80 extending rearwardly and orthogonally relative to the front surface 74 between the side opposed flanges 70,72. The upper flange 80 abuts the bottom wall 28 of the refrigerator 10 and cooperates with each of the pair of guide rails 42, 44, the bottom wall 28, and the floor F to define the cavity C within which the portion of the heat loop tube 62 is disposed.

The toe kick 12 may further include a lower flange 82 extending rearwardly and orthogonally relative to the front surface 74 between the pair of opposed side flanges 70, 72. The lower flange 82 may include a pair of laterally extending mounting ears 84, 86 and a central rearwardly extending mounting ear 88. Each of the pair of laterally extending mounting ears 84, 86 and the central rearwardly extending mounting ear 88 may be mounted to the bottom wall 28 of the main body 14, thus creating a vented enclosure within which the portion of the heat loop tube 62 is contained. Each of the mounting ears 84, 86, 88 may include an ascending vertical portion 90 disposed at an edge 92 of the lower flange 82. A mounting tab 94 may be provided at a distal end 96 of the ascending vertical portion 90 of each of the mounting ears 84, 86, 88 and attached by a fastener 98, such as a nut, threaded to a stud 100 fixed to the bottom wall 28 of the outer chassis 16.

Figure 4:
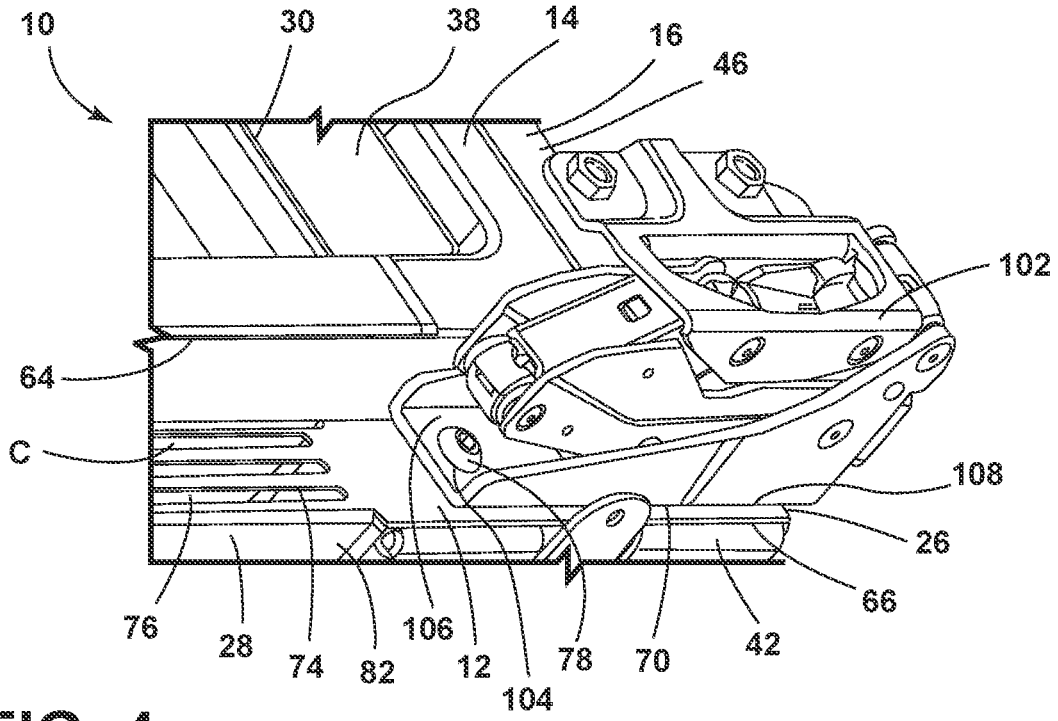
FIG. 4 is an enlarged bottom side perspective view of a lower right corner of the refrigerator equipped with the toe kick of the present disclosure shown in FIG. 1, provided with a closure hinge assembly.

As shown in FIG. 4, a first of the pair of opposed side flanges 70 may be adapted to mount a lower door hinge assembly 102 of the lower closure 38. The fastener 78, such as a threaded bolt, may be inserted through openings 104 in each of a pair of side flanges 106, 108 of the lower door hinge assembly 102, a pair of openings 110 in the first of the pair of opposed side flanges 70, and then into a pair of aligned threaded openings (not shown) in the front face 66 of one of the pair of guide rails 42.

Figure 3:
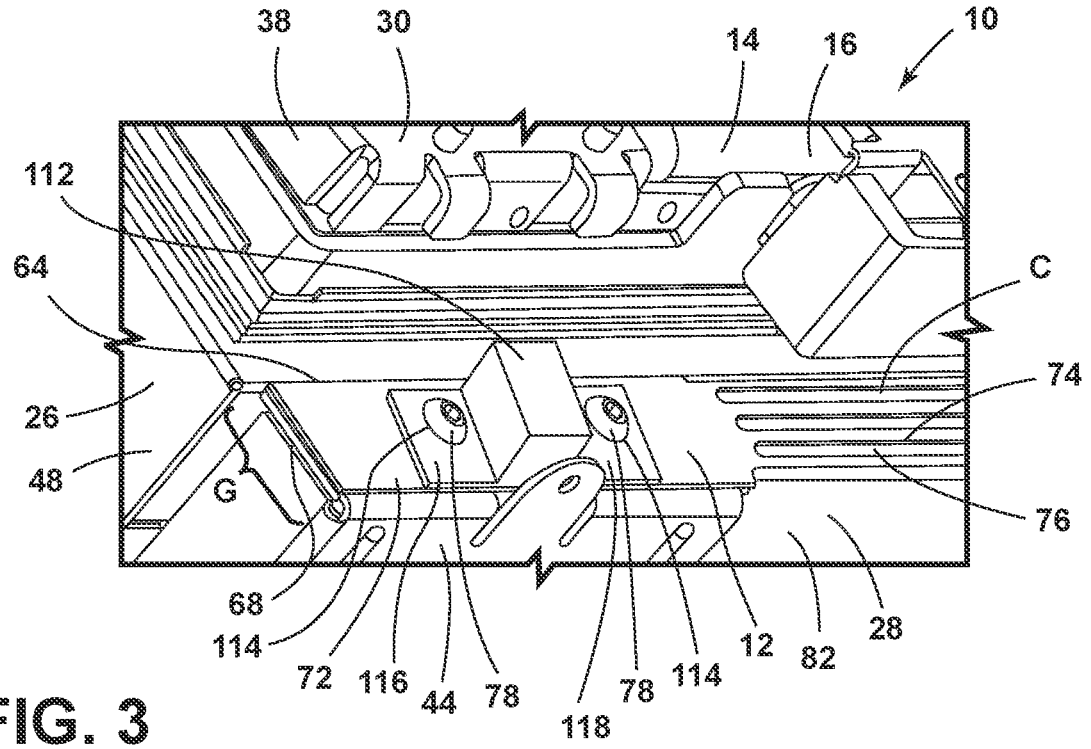
FIG. 3 is an enlarged bottom side perspective view of a lower left corner of the refrigerator equipped with the toe kick of the present disclosure shown in FIG. 1, provided with a closure sensor.

As shown in FIG. 3, a second of the pair of opposed side flanges 72, opposed to the first of the pair of opposed side flanges 70, may be adapted to mount a switch 112 for sensing the position of the lower closure 38. Again, the fastener 78 may be inserted through openings 114 in each of a pair of side flanges 116, 118 of the switch 112, the pair of openings 110 in the second of the pair of opposed side flanges 72, and then into a pair of aligned threaded openings (not shown) in the front face 68 of the other of the pair of guide rails 44. The switch 112 may comprises a reed switch adapted to sense the presence or absence of the lower closure 38, thereby sensing whether the lower closure 38 is in the open position or the closed position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator comprising:

a main body having an outer chassis and an internal storage compartment disposed within the outer chassis, wherein the outer chassis comprises a top wall, a rear wall, a pair of opposed lateral side walls, a bottom wall, and a front side comprising an access aperture and a closure having an open position allowing access to the internal storage compartment and a closed position;

a supporting structure disposed below the internal storage compartment upon which the refrigerator is supported on a floor and forming a cavity below the main body, the supporting structure comprising a pair of guide rails disposed below the main body of the refrigerator and affixed to the bottom wall of the main body along a pair of opposed lateral sides of the main body and extending between the rear wall and the front side of the main body, wherein each of the pair of guide rails is disposed upon the floor by which the refrigerator is supported;

a refrigeration system adapted to provide cooled air within the internal storage compartment, the refrigeration system comprising a heat loop tube adapted to transfer heat energy out of the internal storage compartment, wherein a portion of the heat loop tube extends externally out of the internal storage compartment and is disposed below the main body and within the cavity; and a toe kick disposed proximate a bottom edge of the front side of the main body and proximate the floor for containing the portion of the heat loop tube within the cavity and isolating the portion of the heat loop tube from an exterior of the refrigerator;

wherein:

the toe kick extends across a frontal width of the main body and is mounted to a front face of each of the guide rails by a pair of opposed side flanges;

the toe kick comprises a single piece structure having an exposed substantially flat front surface disposed proximate a lower edge of the main body of the refrigerator;

the pair of opposed side flanges extend laterally from the front surface and provide a mounting structure by which the toe kick is attached to the front face of each of the guide rails by each of the pair of opposed side flanges of the front surface;

the toe kick further comprises an upper flange extending rearwardly and orthogonally relative to the front surface between the pair of opposed side flanges, wherein the upper flange abuts the bottom wall of the refrigerator and cooperates with each of the pair of guide rails, the bottom wall, and the floor to define the cavity within which the portion of the heat loop tube is disposed; and the toe kick further comprises a lower flange extending rearwardly and orthogonally relative to the front surface between the pair of opposed side flanges, wherein the lower flange comprises a pair of laterally extending mounting ears and a central rearwardly extending mounting ear.

2. The refrigerator of claim 1, wherein the pair of guide rails create a vertical gap below the bottom wall of the main body, the vertical gap being equal to a vertical height of each of the pair of guide rails, and the cavity being defined by the vertical height of each of the pair of guide rails, the bottom wall, and the floor.

3. The refrigerator of claim 2, wherein a vertical height of the toe kick corresponds to the vertical gap, and the toe kick extends vertically between a bottom edge of the front side of the main body and the floor.

4. The refrigerator of claim 1, wherein the portion of the heat loop tube is disposed proximate the toe kick.

5. The refrigerator of claim 1, wherein the front surface includes a plurality of horizontally oriented slots by which an air flow may be directed to cool the portion of the heat loop tube.

6. The refrigerator of claim 1, wherein each of the pair of laterally extending mounting ears and the central rearwardly extending mounting ear is mounted to the bottom wall of the main body, thus creating a vented enclosure within which the portion of the heat loop tube is contained.

7. The refrigerator of claim 1, wherein a first of the pair of opposed side flanges is adapted to mount a lower door hinge assembly of the closure.

8. The refrigerator of claim 7, wherein a second of the pair of opposed side flanges, opposed to the first of the pair of opposed side flanges, is adapted to mount a switch for sensing the position of closure.

9. The refrigerator of claim 8, wherein the switch comprises a reed switch.

10. A toe kick for a refrigerator comprising:

a single piece structure having an exposed substantially flat front surface disposed proximate a lower edge of a main body of the refrigerator;

a plurality of horizontally oriented slots disposed on the front surface by which an air flow may be directed to cool a portion of a heat loop tube disposed below the refrigerator;

a pair of opposed side flanges extending laterally from the front surface and providing a mounting structure by which the toe kick is attached to a front face of each of a pair of guide rails disposed below the main body of the refrigerator and upon a floor by which the refrigerator is supported, the pair of guide rails being affixed to a bottom wall of the main body along a pair of opposed lateral sides of the main body and extending between a rear wall and a front side of the main body;

an upper flange extending rearwardly and orthogonally relative to the front surface between the pair of opposed side flanges; and a lower flange extending rearwardly and orthogonally relative to the front surface between the pair of opposed side flanges, wherein the lower flange comprises a pair of laterally extending mounting ears and a central rearwardly extending mounting ear.

11. The toe kick of claim 10, wherein each of the pair of laterally extending mounting ears and the central rearwardly extending mounting ear are mounted to the bottom wall of the main body, thus creating a vented enclosure within which the portion of the heat loop tube is contained.

12. The toe kick of claim 10, wherein the toe kick is disposed proximate a bottom edge of a front side of the main body and proximate the floor for isolating the portion of the heat loop tube within a cavity.

13. A toe kick for a refrigerator comprising:

a single piece structure having an exposed substantially flat front surface disposed proximate a lower edge of and extending across a frontal width of a front side of a main body of the refrigerator;

a pair of opposed side flanges extending laterally from the front surface and providing a mounting structure by which the toe kick is attached to a front face of each of a pair of guide rails disposed below the main body of the refrigerator by each of the pair of opposed side flanges of the front surface and upon a floor by which the refrigerator is supported, the pair of guide rails being affixed to a bottom wall of the main body along a pair of opposed lateral sides of the main body and extending between a rear wall and a front side of the main body;

a lower flange extending rearwardly and orthogonally relative to the front surface between the pair of opposed side flanges, wherein the lower flange comprises a plurality of laterally extending mounting ears and a central rearwardly extending mounting ear by which the toe kick is operably coupled with the bottom wall of the refrigerator; and a plurality of horizontally oriented slots disposed on the front surface by which an air flow may be directed to cool a portion of a heat loop tube disposed in a cavity below the refrigerator;

wherein the toe kick extends across a frontal width of the main body and is mounted to a front face of each of the guide rails by a pair of opposed side flanges; and wherein the toe kick further comprises an upper flange extending rearwardly and orthogonally relative to the front surface between the pair of opposed side flanges, wherein the upper flange abuts the bottom wall of the refrigerator and cooperates with each of the pair of guide rails, the bottom wall, and the floor to define the cavity within which the portion of the heat loop tube is disposed.

14. The toe kick of claim 13, further comprising an upper flange extending rearwardly and orthogonally relative to the front surface between the pair of opposed side flanges, wherein the upper flange abuts the bottom wall of the refrigerator and cooperates with each of the pair of guide rails, the front face of the toe kick, the bottom wall, and the floor to define the cavity within which the portion of the heat loop tube is disposed.

15. The toe kick of claim 13, wherein the refrigerator further comprises a lower door hinge assembly of a closure of the refrigerator, wherein a first of the pair of the pair of opposed side flanges is adapted to mount the lower door hinge assembly of the closure.

* * * * *